US005845713A

United States Patent [19]

Sundholm

[11] Patent Number: 5,845,713

[45] Date of Patent: Dec. 8, 1998

[54] FIRE FIGHTING INSTALLATION FOR DISCHARGING A LIQUID-GAS FOG

[76] Inventor: Göran Sundholm, Ilmari Kiannon kuja 3, FIN-04310 Tuusula, Finland

[21] Appl. No.: 716,164

[22] PCT Filed: Apr. 13, 1995

[86] PCT No.: PCT/FI95/00215

§ 371 Date: Sep. 18, 1996

§ 102(e) Date: Sep. 18, 1996

[87] PCT Pub. No.: WO95/28204

PCT Pub. Date: Oct. 26, 1995

[30] Foreign Application Priority Data

| | | | |
|---|---|---|---|
| Apr. 14, 1994 | [FI] | Finland | 941738 |
| May 30, 1994 | [FI] | Finland | 942534 |

[51] Int. Cl.[6] ..... A62C 35/02

[52] U.S. Cl. ..... 169/9

[58] Field of Search ..... 169/9

[56] References Cited

U.S. PATENT DOCUMENTS

| | | | |
|---|---|---|---|
| 1,501,956 | 7/1924 | Loepsinger | 169/9 |
| 3,199,600 | 8/1965 | Jacobs | 169/9 |
| 3,965,988 | 6/1976 | Wesson et al. | 169/9 |
| 4,318,443 | 3/1982 | Cummins | 169/15 |
| 4,390,069 | 6/1983 | Rose, Jr. | 169/15 |
| 4,520,871 | 6/1985 | Miller et al. | 169/9 |
| 4,981,178 | 1/1991 | Bundy | 169/9 |
| 5,086,846 | 2/1992 | Carlson | 169/15 |
| 5,242,023 | 9/1993 | Terry et al. | 169/9 |

FOREIGN PATENT DOCUMENTS

| | | | |
|---|---|---|---|
| 45104 | 11/1910 | Austria | 169/9 |
| 299098 A | 4/1992 | Germany | 169/9 |
| 875267 | 8/1961 | United Kingdom | 169/9 |
| 9425114 | 11/1994 | WIPO . | |

OTHER PUBLICATIONS

Derwent's abstract, No. 86–148785/23, week 8623, Abstract of SU, 1189458 (EIBOZHENKO A V), 7 Nov. 1985.

Derwent's abstract, No. 86–330389/50, week 8650, Abstract of SU, 787048 (Fire–Fighting Eng C), 15 Dec. 1980.

Derwent's abstract, No. 88–166804/24, week 8824, Abstract of SU, 1353444 (BOGOMOLOV A A), 23 Nov. 1987.

*Primary Examiner*—Gary C. Hoge

*Attorney, Agent, or Firm*—Ladas & Parry

[57] ABSTRACT

A fire-fighting installation has a liquid source (1) for providing a source of a fire-fighting liquid, an outlet line (2) for delivering the fire fighting liquid from the liquid source (1). There is at least one spray head (3) on the outlet line (2) for spraying the fire-fighting liquid delivered by the outlet line (2) at a fire and a gas source (4) connected by way of a line (10) to the outlet line (2) for mixing gas with the fire-fighting liquid delivered to the at least one spray head (3) and produces a finely divided mist of the fire-fighting liquid from the at least one spray head (3). The liquid source has a hydraulic accumulator with at least one liquid tank (1) and a compressed-gas container (1*a*) connected thereto for the delivering of the fire-fighting liquid. The gas source comprises at least one compressed-gas vessel (4,) connected to the at least one liquid tank 1) in such a way that the at least one compressed-gas vessel (4), compressed-gas container (1*a*) and at least one liquid tank are constantly communicating for the delivering of the fire-fighting liquid. The at least one compressed-gas vessel (4) forms communicating vessels with the compressed gas container (1*a*) and the at least one liquid tank (1).

5 Claims, 1 Drawing Sheet

FIRE FIGHTING INSTALLATION FOR DISCHARGING A LIQUID-GAS FOG

The present invention relates to a fire-fighting installation comprising a liquid source and a gas source connected by way of a line to an outlet line of the liquid source for mixing gas with outbound extinguishing liquid delivered to spray heads.

Certain kinds of gasoline fires, for example a kerosene fire in an aircraft jet engine undergoing an engine test in a hangar designed for that purpose, are nearly impossible to extinguish even by means of strong mist-like jets of liquid, as suggested for example in international patent application PCT/FI92/00155. Such a jet engine fire will only go out when the entire hangar, which may typically have a volume of about 3000 $cm^3$, has been subjected to "total flooding", i.e. is in practice entirely filled with liquid mist having very small particles.

The liquid mist can in principle be produced with apparatus as described in international patent application PCT/FI92/00317. In that application, an outgoing ascension tube of a hydraulic accumulator is provided with wall apertures, so that the propellent gas of the accumulator initially drives out liquid only, and after the liquid level has sunk to be even with the uppermost tube wall aperture, mixing of gas into the outbound liquid is gradually started as the liquid level sinks and more tube wall apertures are exposed. In the final stage of emptying the accumulator, it is possible to obtain a liquid mist having sufficiently small droplets for the present purpose, but too large a portion of the liquid contained in the hydraulic accumulator will go waste.

It is an object of the present invention to provide a novel installation enabling effective delivery of liquid with immediate effective mixing of gas into the liquid right from the start.

The installation in accordance with the invention is characterized in that the liquid source comprises a hydraulic accumulator having at least one liquid tank, and that the gas source comprises at least one compressed-gas vessel connected to the liquid tank in such a way that the compressed-gas vessel and liquid tank form communicating vessels, the compressed-gas vessel being adapted to mix gas into the extinguishing liquid delivered to the spray heads to produce a finely divided liquid mist.

A preferred embodiment of the invention is characterized in that a compressed-gas container is coupled to the liquid tank for driving out liquid from said at least one liquid tank, the compressed-gas vessel forming communicating vessels with the liquid tank and the compressed-gas source.

The proportion of gas mixed into the extinguishing liquid is determined by the proportion of the volumes of the propellent gas container of the liquid source and the compressed-gas container of the gas source.

If the propellent gas container of the liquid source and the gas source have the same initial charge pressure, gas is mixed into the extinguishing liquid from the start. If the propellent gas container of the liquid source has a higher initial charge pressure than the gas source, only liquid is discharged from the spray heads in a first step, until the pressure in the propellent gas container of the liquid source has decreased to equal the pressure of the gas source.

In the following the invention will be described with reference to the accompanying drawing showing two preferred embodiments of the installation in accordance with the invention.

Figure 1:
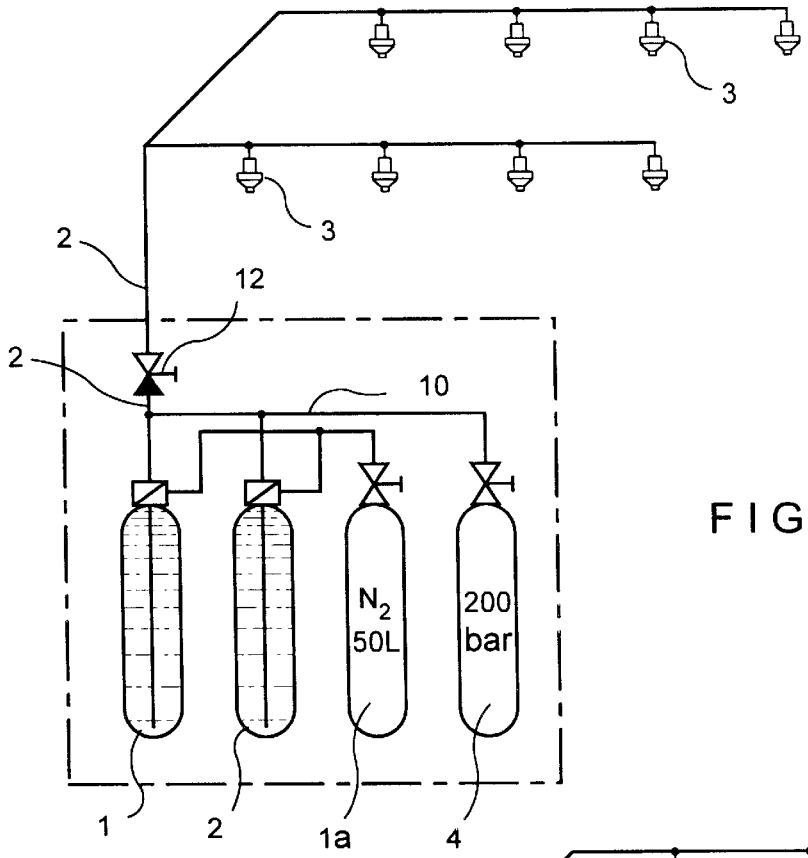
FIG. 1 shows an embodiment having separate sources for propellent gas and gas to be mixed into the extinguishing liquid.

The embodiment shown in FIG. 1 comprises a hydraulic accumulator, having an outlet line 2 leading to a plurality of spray heads 3 via a valve 12. A compressed-gas container in the form of a compressed-gas bottle 4 is connected to the outlet line 2 by way of a line 10. The hydraulic accumulator incorporates two liquid tanks 1, the outlet tubes of which may be provided with apertures, as in international patent application PCT/FI92/00317, and a propellent gas bottle 1*a*.

The liquid tanks 1 may contain for example water. The liquid is driven out from the tanks 1 by means of propellent gas delivered from the propellent gas bottle 1*a*.

The propellent gas bottle 1*a* may be filled with nitrogen, argon, air, etc. In principle, any suitable gas can be used. The initial charge pressure of the propellent gas bottle 1*a* is for instance 100–200 bar. The compressed-gas bottle 4 may contain nitrogen, argon, air, etc. In principle, any suitable gas is possible. The initial charge pressure of the propellent gas bottle 1*a* is the same or higher than the initial charge pressure of the compressed-gas bottle 4. The contents of the propellent gas bottle 1*a* and compressed-gas bottle 4 may be partially in liquid form, depending on the type of gas employed.

The liquid tanks 1, propellent gas bottle 1*a* and compressed-gas bottle 4 form communicating vessels, and thus the emptying of each will be automatically continued until all liquid has been driven out. The proportion of gas to be mixed from bottle 4 is dependent on the ratio between the volumes of the propellent gas bottle 1*a* and the compressed-gas bottle 4. The quantity of liquid relative to the quantity of propellent gas determines the length of the flow; the more liquid, the longer the flow and the lower the final pressure in the propellent gas bottle 1*a* and the compressed-gas bottle 4.

Figure 2:
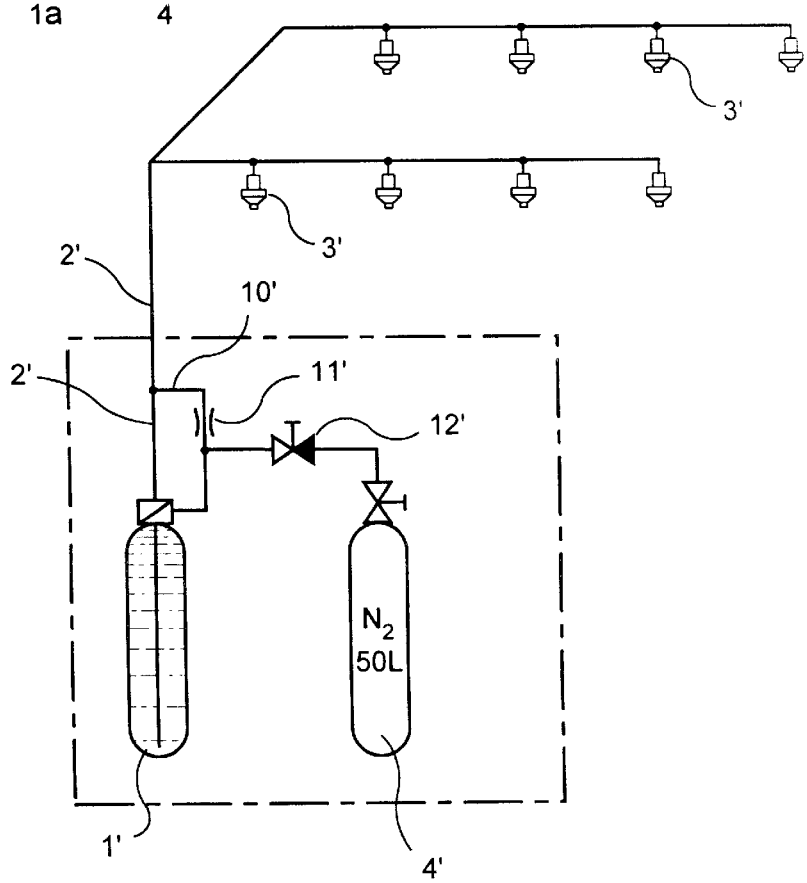
FIG. 2 shows an embodiment in which a common source for propellent gas and gas to be mixed into the extinguishing liquid is provided.

FIG. 2 shows another embodiment of the installation of the invention. This embodiment differs from the embodiment of FIG. 1 mainly in that the propellent gas source for driving liquid out of the liquid tank 1' and the compressed-gas source for mixing gas into the liquid in the line 2' are constituted by the same source 4'. This source is a compressed-gas bottle 4' filled with nitrogen and having an initial charge pressure of approximately 100–200 bar. A line 10' has been coupled between the compressed-gas bottle 4' and the outlet line 2' of the liquid tank 1'.

In the embodiment of FIG. 2, valve 12' has been connected between the throttle 11' and the compressed-gas bottle 4' for activating and alternatively passivating the installation. The valve could, however, be connected directly to the line 2', as in FIG. 1.

The purpose of the throttle 11' is to induce a comparatively large gas flow from the compressed-gas bottle 4' to the liquid tank 1' by choking the gas flow, in which situation the gas flow from the throttle directly to the outlet line 2' is relatively small. In this situation, the throttle 12' adjusts the mixing ratio of liquid and gas in the extinguishing fluid gushing into the outlet line 2'. The throttle 12' is not indispensable. It could be contemplated that the mixing ratio could be adjusted by the dimensioning of the line between branching point 13' and the outlet line 2'.

The invention has been illustrated in the above by way of examples, and it is therefore to be noted that the invention can vary in its details in many ways within the scope of the appended claims. Hence, for example, any compressed-gas vessel may be employed as a compressed-gas bottle 4, 4'. The number of compressed-gas vessels and compressed-gas containers may vary.

I claim:

1. A fire-fighting installation comprising:

a liquid source (1) for providing a source of a fire-fighting liquid;

an outlet line (2) for delivering the fire-fighting liquid from the liquid source (1);

at least one spray head (3) on the outlet line (2) for spraying the fire-fighting liquid delivered by the outlet line (2) at a fire; and a gas source (4) connected by way of a line (10) to the outlet line (2) for mixing gas with the fire-fighting liquid delivered to the at least one spray head (3) and producing a finely divided mist of the fire-fighting liquid from the at least one spray head (3), wherein the liquid source comprises a hydraulic accumulator having at least one liquid tank (1) and a compressed-gas container **(1*a*) connected thereto for the delivering of the fire-fighting liquid and the gas source comprises at least one compressed-gas vessel (4,) connected to the at least one liquid tank (1) in such a way that the at least one compressed-gas vessel (4), compressed-gas container (1*a*)** and at least one liquid tank are constantly communicating for the delivering of the fire-fighting liquid.

2. The installation as claimed in claim 1 wherein the compressed-gas container **(1*a*) and at least one compressed-gas vessel (4)** have at least substantially the same initial charge pressure.

3. The installation as claimed in claim 1, wherein an initial charge pressure of the compressed-gas container **(1*a*)** is 100–200 bar.

4. The installation as claimed in claim 1, wherein an initial charge pressure of the compressed-gas container **(1*a*) is higher than that of the compressed-gas vessel (4)**.

5. The installation as claimed in claim 1, and further comprising a valve (12) in the outlet line (2) for activating and shutting off the delivery of the fire-fighting liquid.

* * * * *